United States Patent [19]

Roux

[11] Patent Number: 4,607,467

[45] Date of Patent: Aug. 26, 1986

[54] UNDERGROUND ROOM SUCH AS NOTABLY A CELLAR

[76] Inventor: Paul M. M. Roux, 30, rue de Damiette, 91190 Gif-sur-Yvette, France

[21] Appl. No.: 458,329

[22] Filed: Jan. 17, 1983

[30] Foreign Application Priority Data

Apr. 27, 1982 [FR] France ..... 82 07292

[51] Int. Cl.[4] ..... E02D 17/04; E04H 9/12

[52] U.S. Cl. ..... 52/169.6

[58] Field of Search ..... 52/169.6, 79.1, 136, 52/137, 79.13, 79.12; 405/134, 133, 272, 273, 280, 275, 11, 15

[56] References Cited

U.S. PATENT DOCUMENTS

| | | | |
|---|---|---|---|
| 824,511 | 6/1906 | Smythe | 52/778 |
| 971,734 | 10/1910 | Donaldson | 405/133 |
| 1,275,874 | 8/1918 | Dowell | 405/133 |
| 2,387,431 | 10/1945 | Dulaney | 52/779 |
| 3,416,273 | 12/1968 | Stucky | 52/79.14 |
| 3,495,371 | 2/1970 | Mitchell | 52/252 |
| 4,231,201 | 11/1980 | Harnois | 52/169.6 |

FOREIGN PATENT DOCUMENTS

| | | | |
|---|---|---|---|
| 201542 | 1/1959 | Austria | 405/133 |
| 0002141 | 8/1979 | European Pat. Off. . | |
| 2350437 | 4/1975 | Fed. Rep. of Germany | 52/252 |
| 3003790 | 6/1981 | Fed. Rep. of Germany . | |
| 3013637 | 10/1981 | Fed. Rep. of Germany . | |

*Primary Examiner*—John E. Murtagh

*Attorney, Agent, or Firm*—Steinberg & Raskin

[57] ABSTRACT

The present invention relates to an underground room, such as notably a cellar, including a floor, a ceiling and lateral walls formed notably by stacked box-sections, prefabricated from concrete, the entire assembly being accommodated in an excavation sunk under a floor slab of a structure, this excavation being lined with a fluid-tight enclosure and provided with a bed of sand. The underground room has vertical posts or columns of reinforced concrete extending from the floor to the level of the ceiling thereof, and having a portion of a predetermined shape. The walls of the stacked box-sections have vertical edges of a shape corresponding to the predetermined shape of the portion of the columns, with the vertical edges bearing against the columns so that the box-sections act as supporting walls to withstand the earth pressure.

13 Claims, 14 Drawing Figures

111
117a
117
117a
117
101
117
111
148
146
105
146
107a
112
107
146
136
107
137
137
105
147
141
106
108
102
115
114
140
106
139
113
141
110
103b
121
104
103a
113
110
9
103
122
100
113
103
121
122

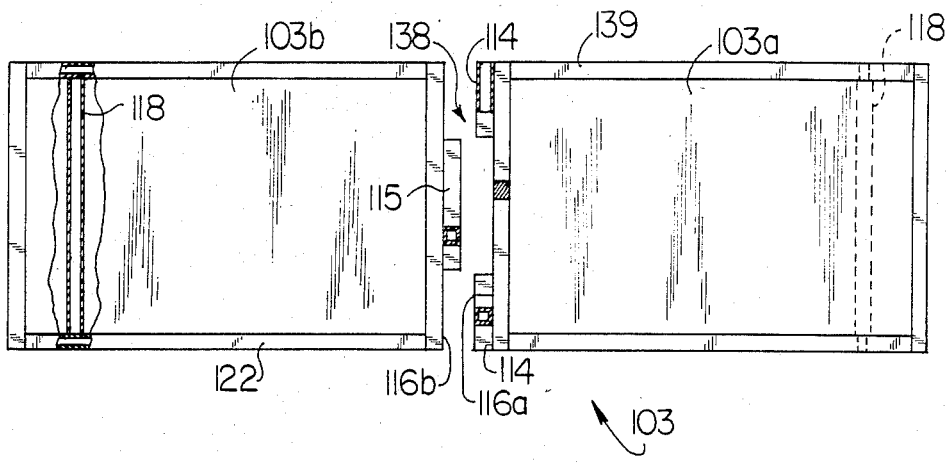
Fig. 9
Fig. 10
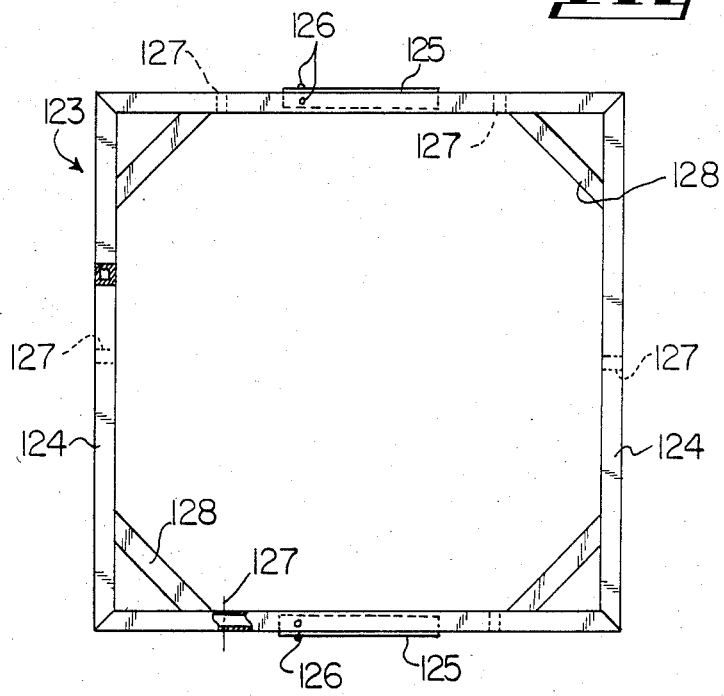

UNDERGROUND ROOM SUCH AS NOTABLY A CELLAR

BACKGROUND OF THE INVENTION

The present invention relates to a sunken, subsurface or underground room such as notably a cellar, and a method of constructing the same in a structure comprising a floor slab, notably of concrete, by which it rests upon the ground, and a removable shielding device used in carrying out the said method.

There is already known a method of constructing a sunken room in a structure originally unprovided therewith. In this known method, there is cut in the floor slab an opening through which an excavation is dug, a fluid-tight covering or pocket lining the said excavation is installed, a base notably of sand is provided, and then a floor, lateral walls constituted by stacked box-sections forming storage racks, and a ceiling. The sunken room obtained by this method is generally cylindrical in shape to ensure its strength.

However, the known method does not allow obtaining a sunken room generally prismatic in shape, such as notably of cubic or rectangled parallelepipedic shape.

SUMMARY OF THE INVENTION

The present invention has as a purpose to obviate this drawback by providing a method of the type described above and characterized in that after providing the floor, there are erected posts or columns, notably of reinforced concrete, extending from the floor to the level of the ceiling, and the box-sections are stacked by being slidingly inserted between the said posts forming retaining and guiding slides.

The posts or columns upon which bear the box-sections forming sustaining walls allow the earth pressure to be withstood, notably in case the sunken room is of prismatic, notably cubic or rectangled parallelepipedic shape.

According to another characterizing feature of the invention, the floor is obtained by arranging spaced parallel beams and laying thereon slabs notably prefabricated from concrete, juxtaposed in mutual contact.

According to still another characterizing feature, before or after installing along a wall a staircase notably prefabricated from sheet metal, ceiling beams are laid, each resting upon two opposite aforesaid posts, and thereafter slabs notably prefabricated from concrete and preferably removable and juxtaposed in mutual contact are laid on the said beams.

In carrying out such a method, the preservation of the pit in a loose soil is an important problem.

In order to solve this problem and according to another characterizing feature of the invention, before constructing the said room proper, the faces of the excavation are shielded as the digging thereof proceeds, leaving uncovered, at the bottom of the said excavation, a space corresponding substantially to at least the height of the lower row of structural members of the room walls, notably of the box-sections.

According to another characterizing feature of the invention, after a first partial digging of the said excavation, a supporting frame is placed at the edges of the said partial excavation, a first series of shielding panels is installed in the said partial excavation against the earth faces of the said excavation; the partial digging of the said excavation is continued; a second series of shielding panels is installed in the said excavation below the said first series of panels; the said panels are fastened together, to the said upper panels and to the said supporting frame; these steps being repeated for as many series of panels as is necessary depending on the desired depth of the said excavation.

According to still another characterizing feature of the invention, the aforesaid first series of panels is constituted by prefabricated dihedral angle members held in position in the corners of the said partial excavation in the shape notably of a rectangular parallelepiped.

According to another characterizing feature of the invention, the fixing of the aforesaid adjacent dihedral angle members is by means of bars, notably of metal and hollow, of square or rectangular cross-section.

According to another characterizing feature of the invention, a free space is provided between the said adjacent dihedral angle members and, if appropriate, a free space is provided between the lower edge of the said dihedral angle members and the bottom of the said partial excavation.

According to still another characterizing feature of the invention, the fixing of the said dihedral angle members to the said supporting frame is by means of threaded tie-rods or the like extending throughout the panels constituting the said dihedral angle members and bolted, on the one hand, to the said supporting frame, and on the other hand, to the lower face of bars notably of metal and substantially H-shaped in cross-section in which are fitted or restrained the lower edges of the said adjacent dihedral angle members.

According to another characterizing feature of the invention, the said dihedral angle members are held in the corners of the said partial excavation by means of round tubes descended into square tubes interconnecting the two panels constituting the said dihedral angle members.

According to still another characterizing feature of the invention, the said panels of the lower series of panels are held in the corners of the said excavation by descending round tubes into the square tubes formed by two square tube portions fixed on one side of a panel and so spaced that a corresponding square-tube portion fixed on the corresponding side of an adjacent panel perpendicular to the previous one is accommodated in the space thus defined to form the said square tube, over the whole length of the corresponding sides of the said panels, which square tube is adapted to receive the said round tube.

According to another characterizing feature of the invention, the said adjacent panels of the said lower series of panels are connected to one another and to the said dihedral angle members, along the walls of the said excavation, by means of the said bars notably of metal and substantially H-shaped in cross-section, leaving a free space between two adjacent panels and, if appropriate, a spacing between the lower edge of the said panels and the bottom of the excavation.

According to still another characterizing feature of the invention, the said panels of the said lower series of panels are fixed to the said supporting frame and to the panel of the said upper series of panels by means of threaded tie-rods descended into the holes extending through the said panels provided in alignment with corresponding holes extending through the said upper panels and the said H-shaped bar, which threaded tie-rods are bolted, on the one hand, to the said supporting frame, and on the other hand, to the lower face of a bar, notably of metal and U-shaped, in which is fitted or restrained the lower edge of two of the said adjacent panels.

The present invention also has as a subject matter a removable excavation-shielding device, notably for carrying out the above method.

The present invention also relates to the sunken, subsurface or underground room, such as notably a cellar, obtained by carrying out the above method. The sunken room is of the type comprising a floor, a ceiling and lateral walls constituted notably by stacked box-sections, notably prefabricated from concrete, the whole assembly being accommodated in an excavation dug under the floor slab of a construction, the said excavation being lined with a fluid-tight covering or enclosure and provided with a base or bed, notably of sand, and is characterized in that the said box-sections fulfil the function of sustaining walls to withstand the earth pressure by bearing against posts, columns or uprights, notably of reinforced concrete, extending from the said floor to the level of the said ceiling.

According to another characterizing feature of the invention, the said floor is constituted by spaced parallel beams, notably of reinforced concrete, upon which rest slabs, notably prefabricated from concrete, juxtaposed in mutual contact. Likewise, the said ceiling is constituted by spaced parallel beams, notably of reinforced concrete, each resting on two opposite aforesaid posts and on which rest slabs, notably prefabricated from concrete, preferably removable, and juxtaposed in mutual contact.

According to another characterizing feature of the invention, the edges of the said slabs are of a shape corresponding to that of the said beams, the said posts and beams being notably T-shaped in cross-section.

According to still another characterizing feature of the invention, the aforesaid substantially parallelepiped shaped box-sections are open entirely or partially at their upper or bottom and internal vertical lateral faces, the vertical edges of the box-section walls bearing against the said posts being preferably of a shape corresponding to that of the said posts. In particular, the edges of the said walls of two adjacent box-sections form a slot in which is accommodated the portion of the said posts which forms a tenon.

According to another characterizing feature of the invention, the said room, which can be enlarged in a parallel direction to the longitudinal horizontal beams supporting the ceiling slabs by adding at least one transverse horizontal joist or the like, for example of reinforced concrete, at the end of the said longitudinal beams and by extending said longitudinal beams with additional longitudinal beams. Likewise, the room can be enlarged in perpendicular relationship to the said longitudinal beams by adding additional longitudinal beams parallel with the first-mentioned longitudinal beams.

According to another characterizing feature of the invention, at least one wall of the said room is constituted by panels or plates, whereas the remaining walls are formed by the said box-sections. Furthermore, at least a portion of a wall of the said room may be constituted by stacked elements open at their bottom, their top face and their face turned towards the inside of the said room.

BRIEF DESCRIPTION OF THE DRAWINGS

For a fuller understanding of the invention, reference is made to the following description, taken in conjunction with the accompanying drawings, in which:

FIG. 8 is a view in the direction of arrow VIII of FIG. 7;

FIG. 9 is a front view of lower shielding panels according to the invention;

FIG. 10 is a top view of the frame for holding the posts or columns, according to the invention;

DETAILED DESCRIPTION OF THE PREFERRED EMBODIMENTS

Figure 4:
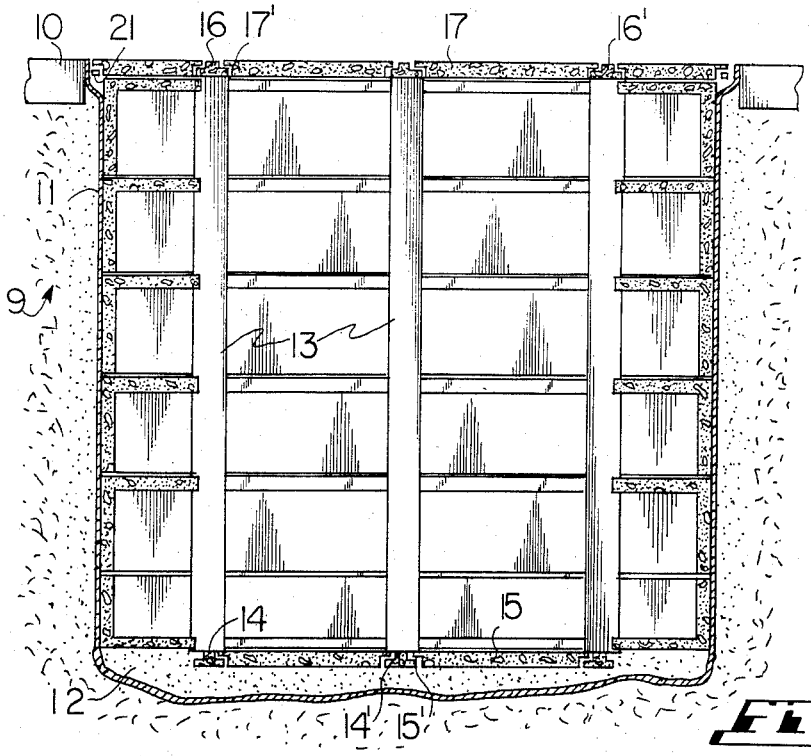
FIG. 4 is a sectional view upon the line IV—IV of FIG. 2.
Figure 1:
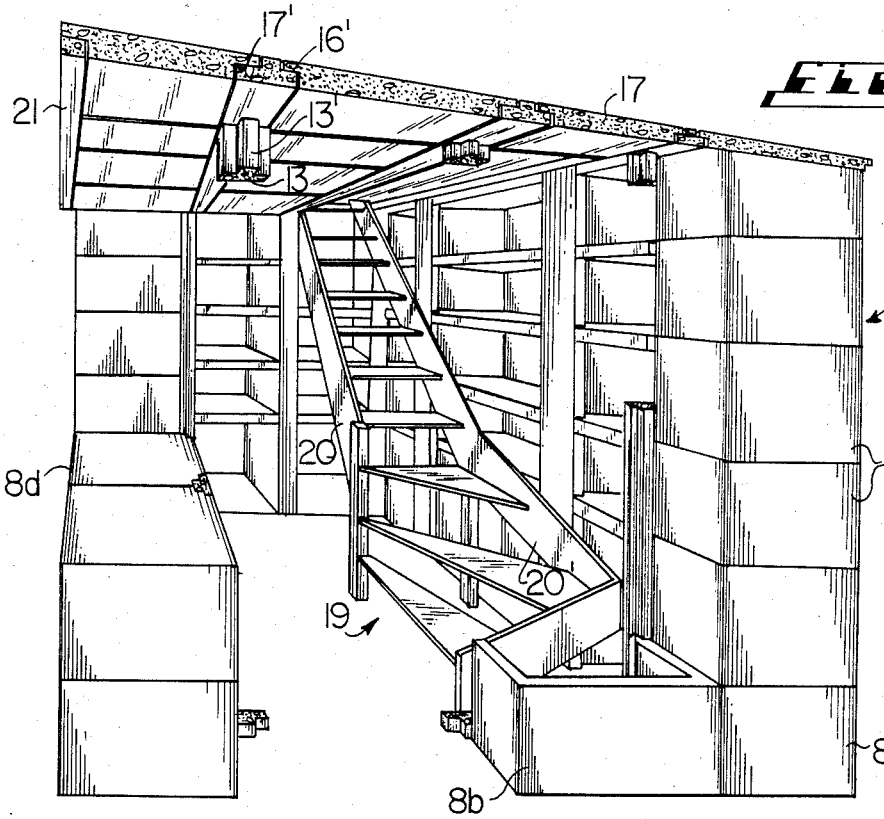
FIG. 1 is perspective, partially broken-away view of a sunken room according to the invention.
Figure 2:
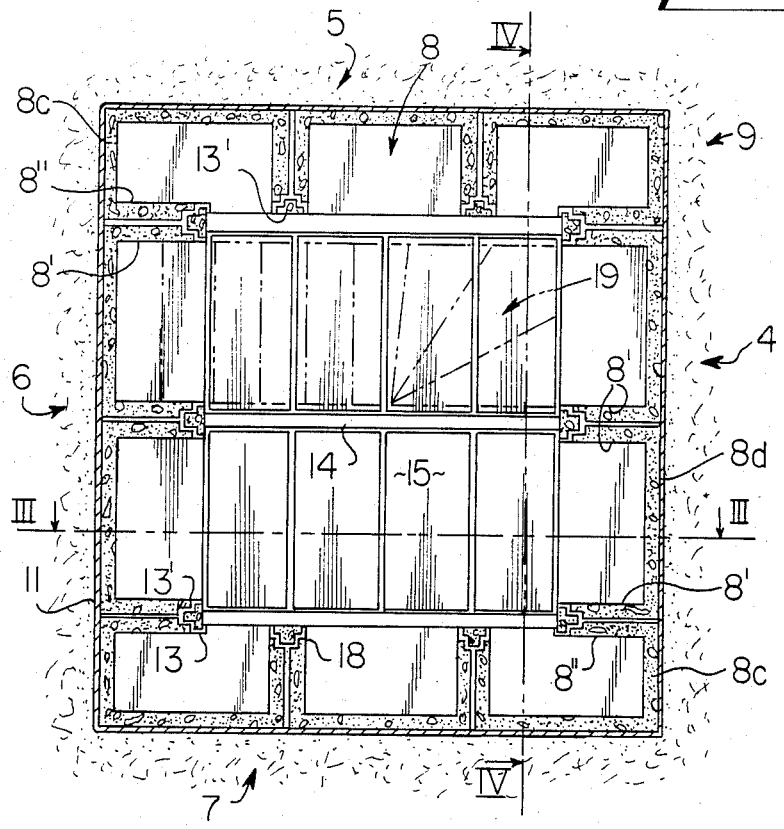
FIG. 2 is a top sectional view upon the line II—II of FIG. 3.
Figure 3:
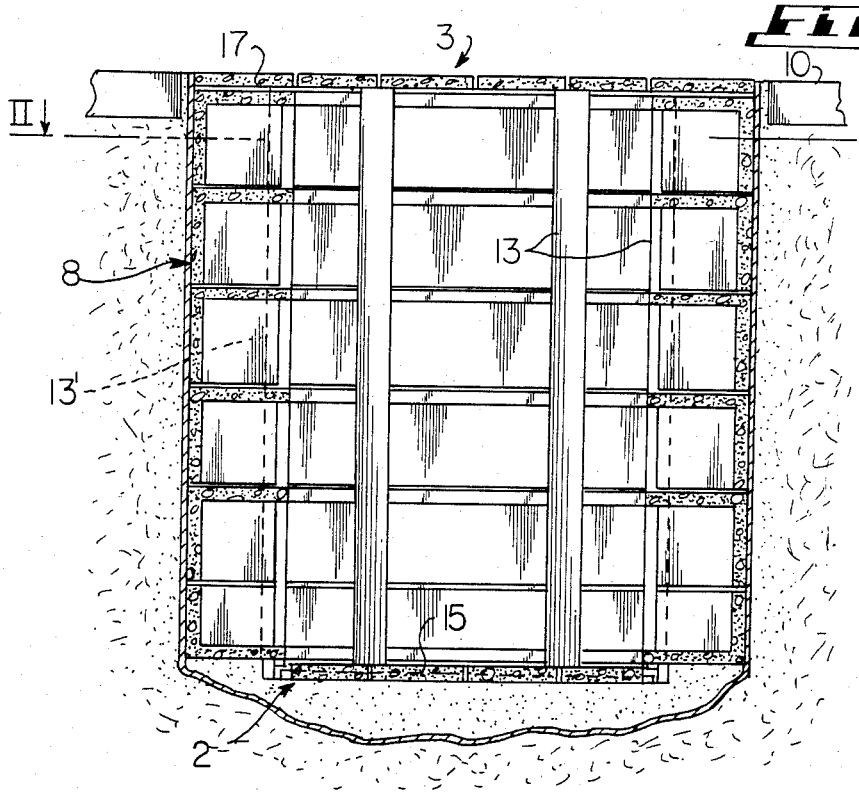
FIG. 3 is a sectional view upon the line III—III of FIG. 2.

The sunken, subsurface or underground room 1, such as notably a cellar, comprises a floor 2, a ceiling 3 and lateral walls 4, 5, 6 and 7 constituted notably by stacked box-sections 8, notably prefabricated from concrete, and serving as storage or stowing racks or bins. The whole assembly is accommodated in an excavation 9 dug or sunk under the floor slab 10 of a structure or construction (not shown), said excavation being lined with a fluidtight covering or enclosure 11 and provided with a base or bed 12 notably of sand.

According to the invention, the structural members of the walls, notably the box-sections 8, fulfil the function of sustaining walls to withstand the earth pressure or thrust by bearing against posts, columns or uprights 13, notably of reinforced concrete, extending from the floor 2 to the level of the ceiling 3, the fixing and holding in place of the said posts being ensured by any appropriate means.

The floor 2 is constituted by spaced parallel beams 14, notably of reinforced concrete, upon which rest slabs 15, notably prefabricated from concrete, and juxtaposed in mutual contact. Furthermore, the ceiling 3 is constituted by spaced parallel beams 16, notably of reinforced concrete, each resting upon two opposite posts 13 and being secured thereto by any appropriate means. Upon the beams 16 and the end cross-bars 21 rest slabs 17, notably prefabricated from concrete, preferably removable, and juxtaposed in mutual contact.

The edges 15', 17' of the slabs 15, 17 are notably of a shape corresponding to that of the beams 14, 16, the posts 13 and the beams 14, 16 being for example T-shaped in cross-section. In this case, the edges 15', 17' of the slabs 15, 17 are provided with a shoulder by which the said slabs rest upon the flanges 14', 16' of the beams 14, 16.

The box-sections 8, notably substantially parallelepipedic in shape, are open, either entirely or partially, on their upper or bottom face and their inner vertical lateral face, i.e. the face which opens into the internal free space of the room. In particular, the vertical edges 18 of the walls of the box-sections 8 bearing against the posts 13 are of a shape corresponding to that of the said posts. Thus, the said edges 18 of two adjacent box-sections form a slot in which is accommodated the portion of the posts 13 which forms a tenon 13'.

The sunken room thus defined is of a shape which is generally prismatic, notably cubic or rectangular parallelepipedic. In the form of embodiment illustrated, and by way of example, the room of rectangular parallelepipedic shape is constructed with four types of box-sections. The lowest box-sections 8*a*, 8*b* forming the base of the room walls have no upper wall, the angle box-sections 8*a* being partially open at their internal vertical lateral face, whereas the straight box-sections 8*b* are completely open at their internal vertical lateral face. The angle and straight box-sections 8*c* and 8*d* other than those of the said base have no bottom, the function of such a bottom being fulfilled by the upper face of the immediately lower box-sections. In the same manner as the box-sections forming the said base, the angle box-sections 8*c* are partially open at their internal vertical lateral face, whereas the straight box-sections 8*d* are completely open at their internal vertical lateral face. Quite obviously, the external lateral wall of the box-section constitutes the lateral wall of the room.

In the form of embodiment illustrated, and by way of example, the larger lateral walls of the room are constituted by six levels of stacked box-sections, one of which is a base level, each row being constituted by two straight box-sections and two angle box-sections, whereas the smaller lateral walls of the room are of course also constituted by six levels of stacked box-sections, each of which comprises a straight box-section and two angle cross-sections. Each level of box-sections can also comprise, in the example illustrated, six straight box-sections, i.e., four for the two larger walls and two for the two smaller walls, and four angle box-sections.

The box-sections 8 bear against the columns 13 notably by the vertical edges 18 of the adjacent vertical lateral walls 8', 8'' of the adjacent box-sections. In particular, for the angle box-sections 8*a*, 8*c*, one of these walls is constituted by the wall 8'' partially closing their internal vertical lateral face. In the example of embodiment illustrated, three aligned columns 13 are provided to prop up the larger walls of the room and two columns 13 are also provided to prop up the smaller walls of the room. The said columns thus define, in this form of embodiment, a free space of rectangular parallelepipedic shape.

Figure 11:
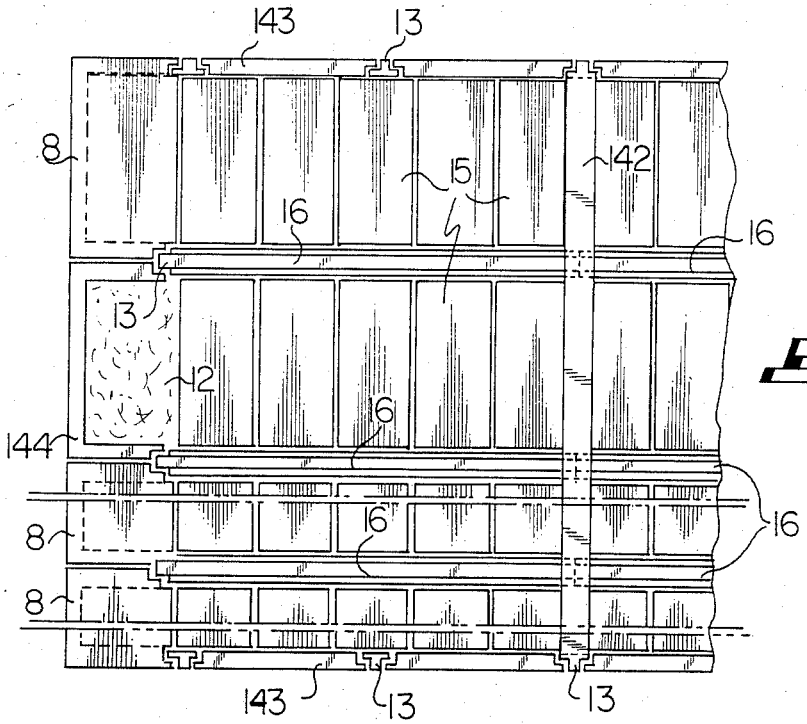
FIG. 11 is a top view of a sunken room according to the invention.
Figure 12:
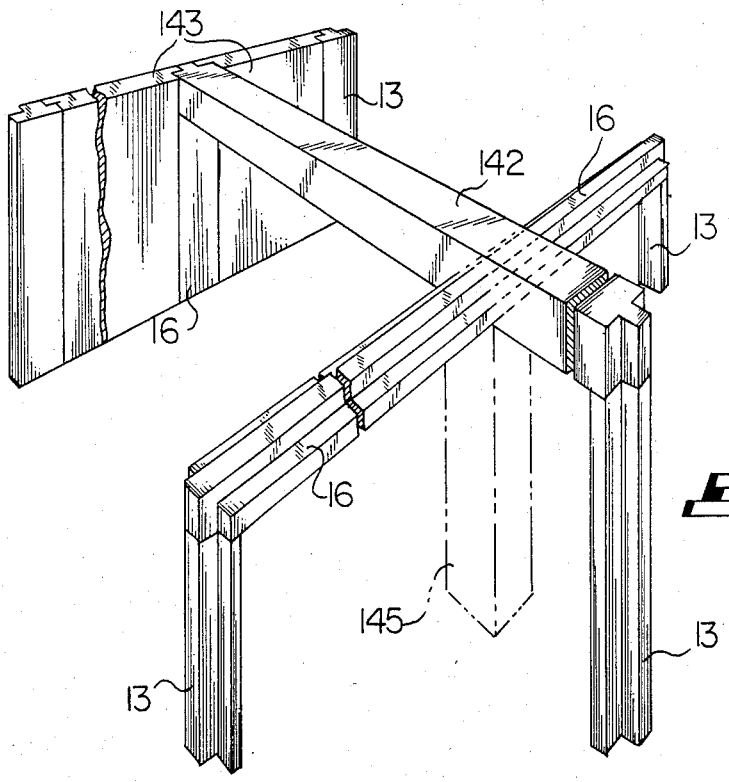
FIG. 12 is a partial perspective view of structural members of the room according to the invention.
Figure 14:
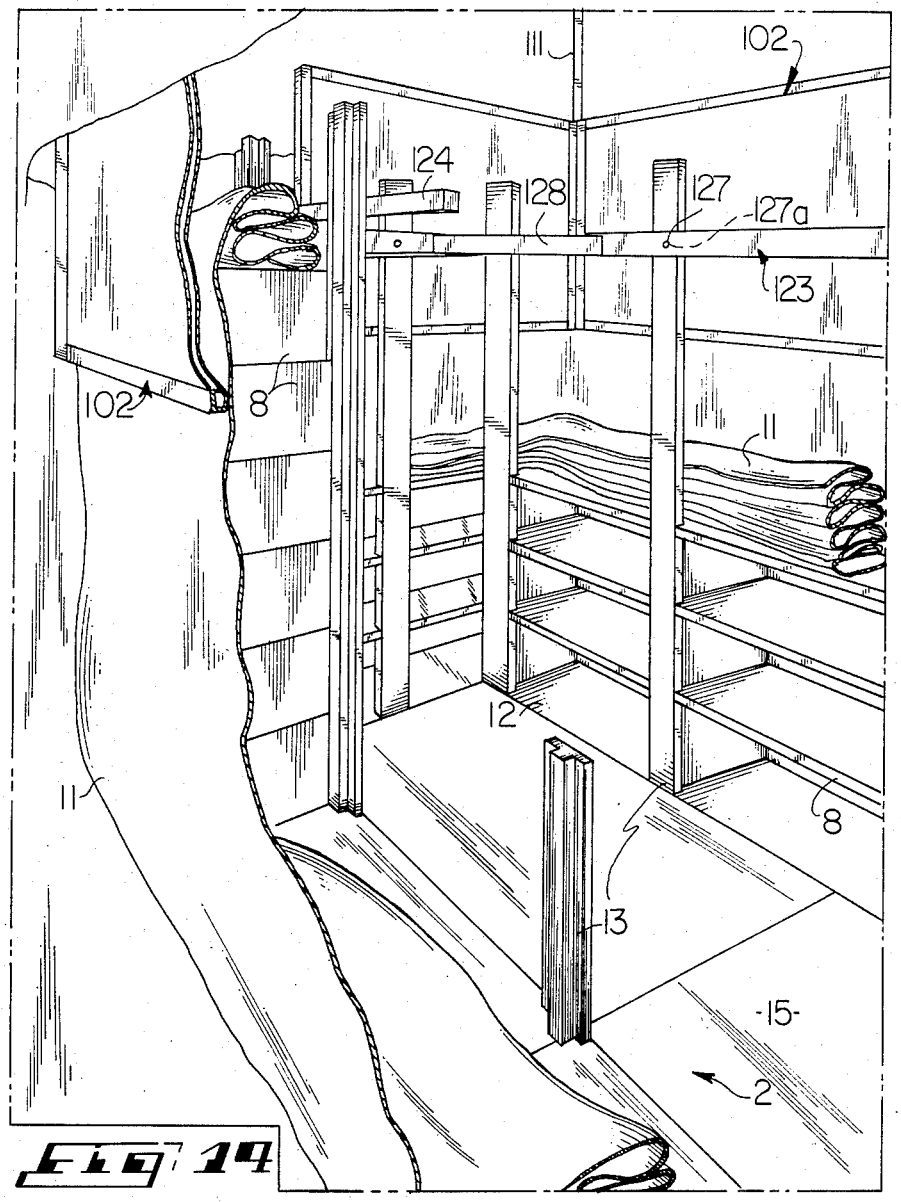
FIG. 14 is a partial perspective view of the room according to the invention during its construction.

Referring more particularly to FIGS. 11 and 12, the room 1 can be enlarged in a parallel direction to the longitudinal horizontal beams 16 supporting the ceiling slabs, by adding at least one transverse horizontal joist or the like 142, e.g. of reinforced concrete, at the end of the longitudinal beams 16 and by extending the said beams with additional longitudinal beams 16. The joist 142 may be cast on site using an appropriate form, the corresponding end of the first beams 16 and of the additional beams being embedded in the concrete. Depending on the desired total height of the room, there may be provided an intermediate supporting post or column 145 placed notably in the region of the junction of the two series of longitudinal beams.

Likewise, the room 1 can be enlarged in a perpendicular direction to the longitudinal beams 16 by means of additional longitudinal beams 16 parallel to the first longitudinal beams 16.

Figure 13:
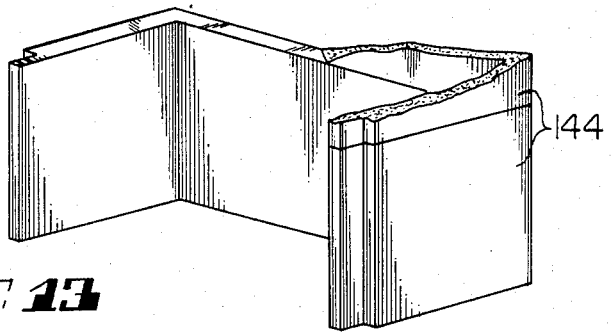
FIG. 13 is a perspective view of a structural member of the room walls according to the invention.

Furthermore, at least one wall of the room 1 may be constituted by panels or plates 143, the remaining walls being formed by the box-sections 8. Likewise, at least a portion of a wall of the room 1 may be constituted by members 144 (FIG. 13) open at their bottom, their top face and their face turned towards the interior of the room 1.

The removable shielding device for the excavation 9, according to the invention, comprises a supporting frame 101 placed at the edges of the excavation 9 and a certain number of series of shielding panels 102, 103 arranged along the earth walls or faces 100 of the excavation 9 and removably fixed to the supporting frame 101. The number of series of shielding panels of course depends upon the desired depth of the excavation and on the dimensions of the said panels. In the example illustrated, and referring more particularly to FIG. 5, use is made of two series of shielding panels, each series being constituted by eight panels or half-panels, i.e., two panels per face of the excavation. This number may of course be changed depending on the desired dimensions of the excavation, e.g. by adding panels between the ones placed at the corners of the excavation.

Figure 6:
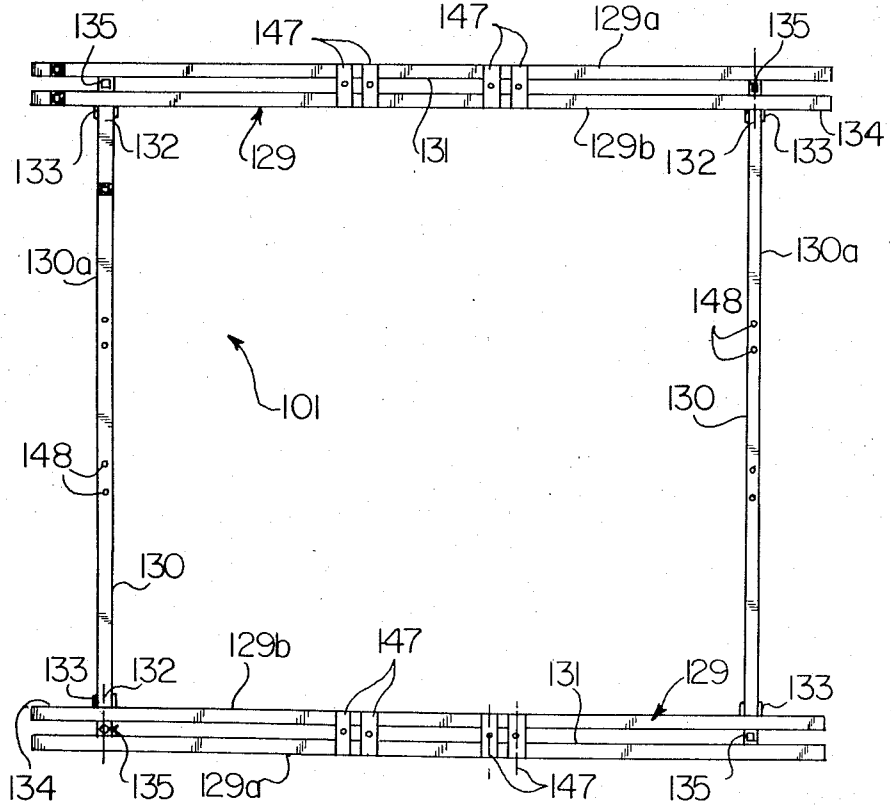
FIG. 6 is a top view of the supporting frame according to the invention.

Referring in particular to FIG. 6, the supporting frame 101, notably rectangular in shape, is constituted by two pairs of spaced parallel bars 129, notably of metal, each pair of bars being connected to the other pair by bars 130 parallel to one another and substantially perpendicular to the said pairs of bars 129. The spacing between the pairs of bars 129 and the bars 130 perpendicular to the said pairs is selected according to the dimensions of the opening of the excavation 9 so that the earth faces 100 of the excavation extend in prolongation, on the one hand, of the internal face at 131 of the external bar 129*a* of the said pairs, and, on the other hand, of the external faces 130*a* of the bars 130, the terms "external" and "internal" being understood with respect to the excavation 9.

The ends 132 of the bars 130 are fitted into supporting lugs 133 of U-shaped cross-section secured, notably welded, to the internal faces 134 of the internal bars 129*b* of each of the said pairs of bars, the spacing between the bars 129 being maintained by substantially vertical, square tube portions 135 located in the region of the corners 104 of the excavation 9 and allowing the bars 129 to be secured to one another.

Figure 7:
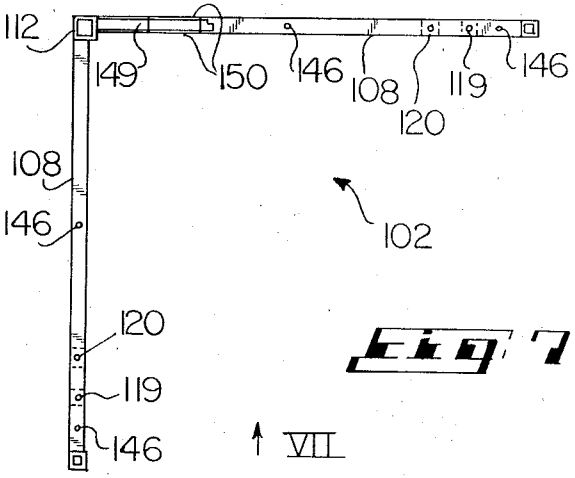
FIG. 7 is a top view of an upper dihedral shielding panel according to the invention.

Referring more particularly to FIGS. 7 and 8, the series of upper panels 102 is constituted by dihedral angle members formed by two substantially perpendicular panels 108 secured to one another by a substantially vertical, square tube 112 adapted to receive a round tube 111 for positioning of the dihedral angle members in the corners 104 of the excavation 9.

Figure 5:
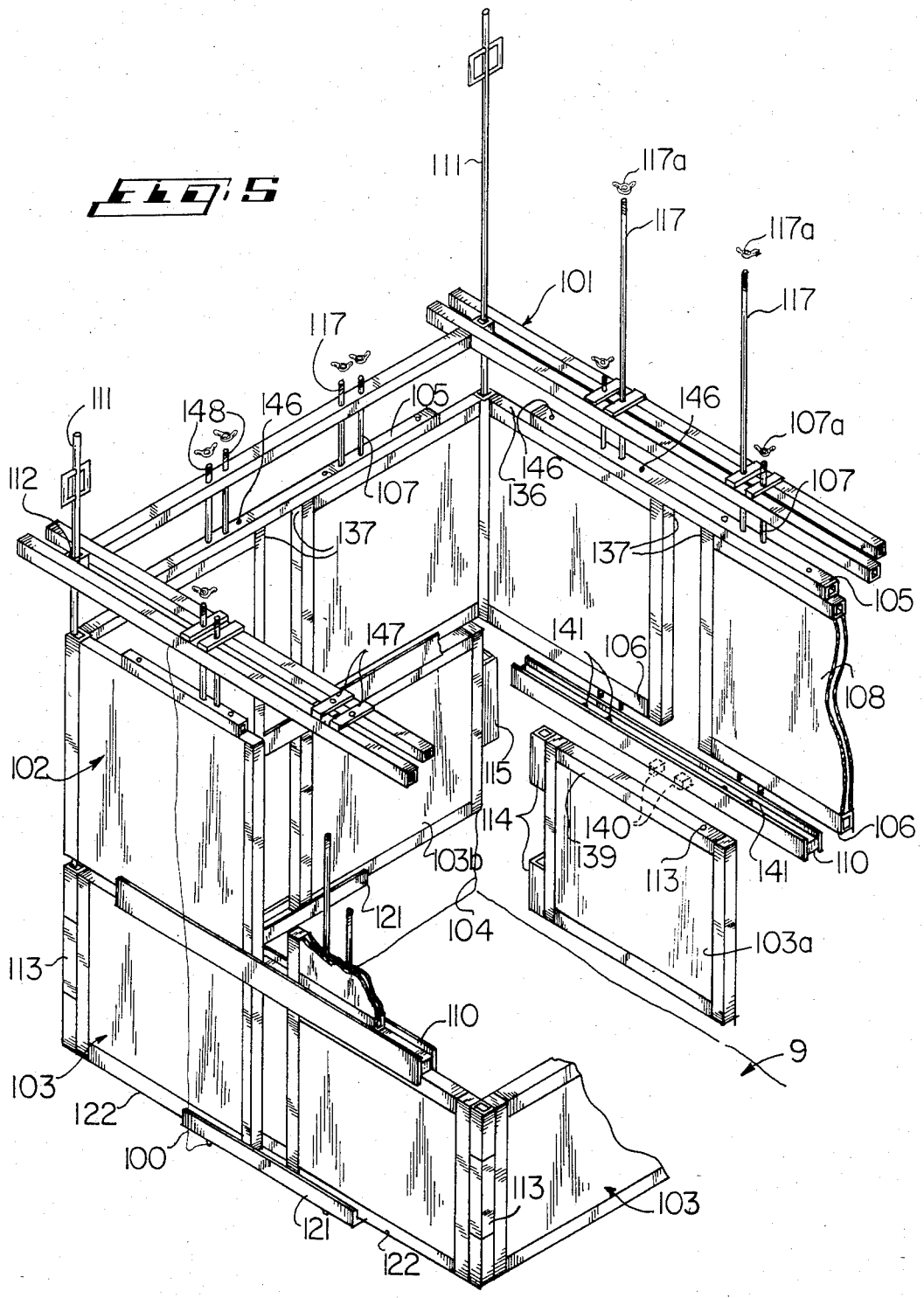
FIG. 5 is a partial perspective view of the shielding device according to the invention.
Figure 4:
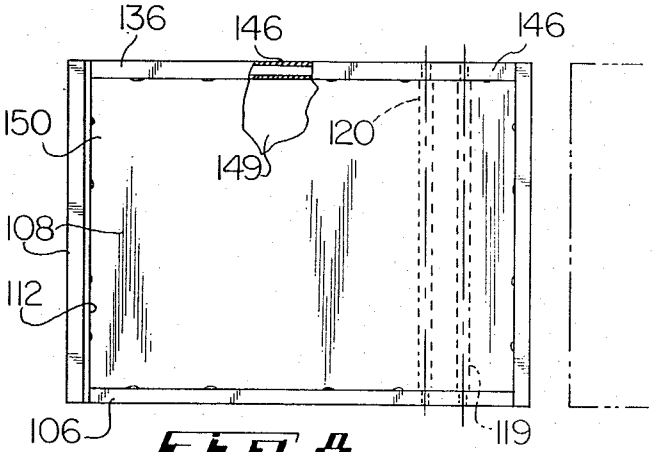

Referring to FIG. 5, a bar 105, notably hollow and square or rectangular in cross-section, is secured, during the mounting of the removable shielding device, to the upper edges 136 of two adjacent panels 108 along a wall of the excavation 9, notably by fastening means 146, abutments 137 being provided to maintain a certain spacing between the adjacent panels 108 so as to allow for the stresses resulting from the earth pressure.

Referring more particularly to FIG. 9, a series of lower panels 103 are constituted by flat panels provided with means 138 for their positioning substantially at 90° with respect to one another. These means are notably constituted by two square-tube portions 114 secured on one side 116*a* of a panel 103*a* and so spaced that a corresponding square-tube portion 115 secured to the corresponding side 116*b* of an adjacent panel 103*b* and substantially perpendicular to the previous one is accommodated in the space thus defined to form a square-tube 113 over the whole length of the corresponding sides 116*a*, 116*b* of the said panels, and adapted to receive the round tube 111.

Furthermore, the upper and lower panels 102 and 103 are provided with through holes 120, 119; 118, respectively, for the passage of threaded tie-rods or the like 107, 117, respectively, for fixing the said panels 102, 103 to the support frame 101. The threaded tie-rods 107, 117, respectively, are provided with nuts 107*a*, 117*a* for fixing them to the frame 101, as well, of course, as nuts provided at their lower ends to allow the fixing of the panels 102, 103 to one another and to the supporting frame 101. The supporting frame 101 is provided, on the one hand, between the pairs of parallel bars 129, with plates 147 drilled to allow the passage of the threaded tie-rods 107, 117 therethrough and, on the other hand, the parallel bars 130 of the supporting frame 101 are provided with holes 148 for the passage of other threaded tie-rods or the like 107, 117.

Referring more particularly to FIG. 5, the removable shielding device according to the invention also comprises substantially H-shaped sections 110. In each of the said sections are fitted or restrained, on the one hand, the lower end 106 of two adjacent upper panels 108 along a wall of the excavation 9 and, on the other hand, the upper edge 139 of two lower adjacent panels 103 along a wall of the excavation 9, thus allowing the fixing of two lower panels 103 to one another while at the same time maintaining a space therebetween, notably through the medium of abutments 140, and the fixing of the latter to the corresponding upper panels 108, the said section being traversed by holes 141 corresponding to the aforesaid through holes 120, 119; 118.

The shielding device also comprises a certain number of substantially U-shaped sections 121. In each of these sections are fitted or restrained the lower edges 122 of two adjacent lower panels 103 along a wall of the excavation 9, the threaded tie-rods 117 being bolted to the lower face of the said sections 121 so as to maintain the whole of the shielding device, in particular the lower panels 103, on the supporting frame 101.

The aforesaid panels 108, 103 are constituted notably by a body of wood 149, in particular of plywood, provided, if appropriate, with a lining 150 notably of metal.

Herebelow is described in detail the method of constructing a sunken room 1, such as notably a cellar, according to the invention.

Before constructing the room 1 proper, the earth faces 100 of the excavation 9 are shielded as the sinking of the latter proceeds, leaving uncovered, at the bottom of the excavation 9, a space corresponding substantially to at least the height of the lower row of structural members of the room walls, notably the box-sections 8.

After a first partial sinking of the excavation 9, a supporting frame 101 is laid on the edges of the partial excavation, a first series of shielding panels 102 is installed in the partial excavation against its earth faces, the panels 102 are fixed together and to the supporting frame 101, and then the partial sinking of the excavation 9 is continued, a second series of shielding panels 103 is installed in the excavation below the first series of panels 102, the panels 103 are fixed together, to the upper panels 102 and to the supporting frame 101, these steps being repeated for as many series of panels as necessary depending on the desired depth of the excavation.

The first series of panels 102, constituted by dihedral angle members, notably prefabricated, is fixed in position in the corners 104 of the partial excavation which, notably, is of substantially rectangular parallelepipedic shape. The fixing of the adjacent dihedral angle members 102 is obtained by means of the bars 105, notably of metal and hollow, of square or rectangular section, and using a fastening means 146. A free space is maintained between the adjacent dihedral angle members 102 and, if appropriate, a free space is left between the lower edge 106 of the dihedral angle members 102 and the bottom of the partial excavation. The fixing of the dihedral angle members 102 to the supporting frame 101 is performed by means of the threaded tie-rods or the like 107 traversing the panels 108 of the dihedral angle members 102 through the holes 120 provided therein. The threaded tie-rods 107 are bolted, on the one hand, to the supporting frame 101 by means of nuts or the like 107*a*, and, on the other hand, to the lower face 109 of the bars 110, notably of metal and substantially H-shaped in cross-section, in which are fitted or restrained the lower edges 106 of the adjacent dihedral angle members 102.

The dihedral angle members 102 are held in the corners 104 of the partial excavation by letting down the round tubes 111 through the square tubes 112 interconnecting the two panels 108 constituting the said dihedral angle members.

Thereafter, a further partial sinking of the excavation 9 is performed and the panels 103 of the lower series of panels are installed against the earth faces 100 of the excavation.

The fixing of the panels 103 in the corners 104 of the partial excavation is obtained by letting down the round tubes 111 through the square tubes 113 formed by the tube portions 114 and 115 joined together during the positioning, substantially at 90°, of the panels 103 in the corners of the excavation.

The adjacent panels 103 are connected to one another and to the dihedral angle members 102 by means of the bars 110 of substantially H-shaped cross-section, leaving a free space between two adjacent panels 103 and, if appropriate, a spacing between the lower edge 122 of the said panels and the bottom of the partial excavation.

Thereafter, panels 103 are fixed to the supporting frame and to the panels 102 of the upper series of panels by descending threaded tie-rods 117 through the holes 118 traversing the panels 103 provided in alignment with corresponding holes 119 extending through the upper panels 108 as well as the corresponding holes 141 provided in the bars 110. The threaded tie-rods 117 are bolted, on the one hand, to the supporting frame 101, notably by means of nuts 117*a* and, on the other hand, to the lower face of the U-shaped bars 121, notably of metal, in which are fitted the lower edges 122 of two adjacent panels 103.

Quite obviously, the order of succession of the above steps may be modified to allow for the various conditions under which the method according to the invention may be carried out.

Once the removable shielding device according to the invention is installed according to the above described method, and after the excavation is dug to its final depth, a fluid-tight pocket, covering or enclosure 11 is lowered into the excavation 9, the joist 14 and slabs 15 of the floor 2 are installed, a peripheral bed 12 serving to support the structural members of the walls, notably the box-sections 8, is poured, and posts or columns 13, notably of reinforced concrete are errected extending from the floor 2 to the level of the ceiling 3.

Thereafter, a temporary holding frame 123, notably of metal, is placed at the top of the columns 13 to hold the same in position, the said holding frame being notably fixed on threaded sleeves 127*a* provided at the top of the columns 13.

Referring more particularly to FIG. 10, the holding frame 123 is constituted by two members 124 which, when joined together, form a quadrilateral. The fixing of the two members 124 is performed by means of angle bars 125, a portion of which is welded to one of members 124 whereas the other portion is bolted at 126 to the other member 124. Fixing means 127 are provided which coincide with the sleeves 127*a* of the columns 13. Braces 128 are provided at the four corners of the holding frame 123.

There are thereafter lowered into the excavation the first structural members of the walls of the room 1, notably a first row of box-sections 8 which lock the whole assembly at its bottom, by sliding the box-sections 8 between the columns 13 which thus act as holding and sliding guides; thereafter the fluid-tight enclosure 11 is unfolded up to the upper level of the said structural members or box-sections, while at the same time a fill, notably of sand, is raised.

Thereafter the aforesaid lower panels 103 are removed by unbolting the threaded tie-rods 117, unkeying the U-shaped bars 121 and raising the round tubes 111 in the corners 104.

Thereafter the successive upper levels of the structural members or box-sections 8 are installed at the same time as the fluid-tight enclosure 11 is unfolded.

Once the whole assembly of the structural members of the room walls is installed, the dihedral angle panels 102 and the supporting frame 101 are removed by being lifted; thereafter, the tie-members of reinforced concrete interconnecting the columns are cast and the temporary frame for holding the columns 13 is withdrawn.

Thereafter, the beams 16 of the ceiling 3 are laid, each resting upon two opposite columns 13. After fixing the said beams, there are laid thereon the slabs 17, notably prefabricated from reinforced concrete, preferably removable and juxtaposed in mutual contact. There is also installed a staircase 19, notably prefabricated from sheet metal, along one of the walls, the said staircase comprising notably two lateral stringers 20, 20' or a single central stringer.

What is claimed is:

1. An underground room, having a form which is generally prismatic, cubic or rectangular parallelepipedic, and including a floor, a ceiling, and lateral walls formed by stacked box-sections prefabricated from concrete and serving as storage bins each having at least two vertical lateral walls, the entire assembly being accommodated in an excavation sunk under a floor slab of a structure, said excavation being lined with a fluid-tight enclosure and provided with a bed of sand, wherein said room comprises vertical posts or columns, extending from said floor to the level of the ceiling and being fixed and maintained in place therebetween, said vertical columns being substantially T-shaped in cross-section and constituting means for withstanding earth pressure, and wherein said vertical lateral walls of said spaced-box sections forming storage bins having vertical edges bearing against said columns, with said box-sections forming supporting walls to withstand the earth pressure, said vertical edges of two adjacent box-sections of the same level forming a slot in which is accommodated a portion forming a tenon of one T-shaped column.

2. A room according to claim 1, wherein said floor is formed by spaced parallel beams of reinforced concrete, upon which rest slabs prefabricated from concrete and juxtaposed in mutual contact.

3. A room according to claim 1, wherein said ceiling is formed by spaced parallel beams of reinforced concrete, each resting upon two opposite aforesaid columns, and on which rest slabs prefabricated from concrete, and juxtaposed in mutual contact.

4. A room according to claim 3, wherein the slabs are removable.

5. A room according to claim 2, wherein the edges of the said slabs are of a shape corresponding to that of the edges of said beams.

6. A room according to claim 2, wherein said beams are substantially T-shaped in cross-section.

7. A room according to claim 1, wherein said box-sections of a substantially rectangular parallelepipedic shape are open either entirely or partially at upper or bottom faces thereof and internal vertical lateral faces thereof.

8. A room according to claim 1, wherein said room is enlarged in a parallel direction to said longitudinal horizontal beams supporting the ceiling slab by adding at least one horizontal joist, of reinforced concrete, which extends transversally between the ends of said longitudinal beams and by extending said longitudinal beams with additional longitudinal beams.

9. A room according to claim 1, wherein at least one wall of said room is formed by panels or plates whereas said remaining walls are formed by said box-sections.

10. A room according to claim 1, wherein said vertical columns are formed of reinforced concrete.

11. An underground room, having a form which is generally prismatic, cubic or rectangular parallelepipedic, and including a floor, a ceiling, and lateral walls formed by stacked box-sections prefabricated from concrete and serving as storage binx each having at least two vertical lateral walls, the entire assembly being accommodated in an escavation sunk under a floor slab of a structure, said excavation being lined with a fluid-tight enclosure and provided with a bed of sand, wherein said room comprises vertical posts or columns extending from said floor to the level of the ceiling and being substantially T-shaped in cross-section and constituting means for withstanding earth pressure, said floor and ceiling are formed by spaced parallel beams, each respective beam of the floor and ceiling is secured to two opposite vertical columns, and said vertical lateral walls of said box-sections forming storage bins have vertical edges bearing against said columns with said box-sections forming supporting walls to withstand the earth pressure, said vertical edges of two adjacent box-sections of the same level forming a slot in which is accommodated a portion forming a tenon of one T-shaped column.

12. A room according to claim 11, wherein said vertical columns are formed of reinforced concrete.

13. A room according to claim 11, wherein said parallel beams are formed of reinforced concrete.

* * * * *

UNITED STATES PATENT AND TRADEMARK OFFICE

CERTIFICATE OF CORRECTION

PATENT NO. : 4,607,467

DATED : August 26, 1986

INVENTOR(S) : Paul M. M. Roux

It is certified that error appears in the above—identified patent and that said Letters Patent is hereby corrected as shown below:

On the title page Item [30] should read

[30] Foreign Application Priority Dates

Apr. 27, 1982 [FR] France.....82 07292

Jan. 5, 1983 [FR] France.....83 00104__.

Signed and Sealed this

Twenty-sixth Day of April, 1988

*Attest:*

DONALD J. QUIGG

*Attesting Officer*

*Commissioner of Patents and Trademarks*